US009310038B2

(12) United States Patent
Athalye

(10) Patent No.: US 9,310,038 B2
(45) Date of Patent: Apr. 12, 2016

(54) LED FIXTURE WITH INTEGRATED DRIVER CIRCUITRY

(71) Applicant: CREE, INC., Durham, NC (US)

(72) Inventor: Praneet Jayant Athalye, Morrisville, NC (US)

(73) Assignee: CREE, INC., Durham, NC (US)

( * ) Notice: Subject to any disclaimer, the term of this patent is extended or adjusted under 35 U.S.C. 154(b) by 104 days.

(21) Appl. No.: 13/787,727

(22) Filed: Mar. 6, 2013

(65) Prior Publication Data

US 2013/0250579 A1 Sep. 26, 2013

Related U.S. Application Data

(63) Continuation-in-part of application No. 13/429,080, filed on Mar. 23, 2012.

(60) Provisional application No. 61/672,020, filed on Jul. 16, 2012, provisional application No. 61/676,310, filed on Jul. 26, 2012.

(51) Int. Cl.
*F21V 21/00* (2006.01)
*F21S 8/02* (2006.01)
(Continued)

(52) U.S. Cl.
CPC . *F21S 8/026* (2013.01); *F21V 3/04* (2013.01); *F21V 7/0066* (2013.01); *F21V 7/041* (2013.01); *F21V 21/00* (2013.01); *F21V 21/047* (2013.01); *F21S 8/04* (2013.01); *F21V 3/02* (2013.01); *F21V 7/22* (2013.01); *F21V 21/044* (2013.01); *F21V 23/005* (2013.01); *F21V 23/023* (2013.01); *F21V 29/15* (2015.01); *F21Y 2101/02* (2013.01); *H05B 33/0815* (2013.01)

(58) Field of Classification Search
None
See application file for complete search history.

(56) References Cited

U.S. PATENT DOCUMENTS

| | | | | |
|---|---|---|---|---|
| D85,382 | S | 10/1931 | Guth | D26/24 |
| 2,356,654 | A | 8/1944 | Cullman | 362/223 |

(Continued)

FOREIGN PATENT DOCUMENTS

| | | |
|---|---|---|
| CN | 1762061 | 4/2006 |
| CN | 1934389 | 3/2007 |

(Continued)

OTHER PUBLICATIONS

XLamp®C family from Cree®. Inc., Product Family Data Sheet, 15 pages.

(Continued)

*Primary Examiner* — Britt D Hanley
(74) *Attorney, Agent, or Firm* — Koppel, Patrick, Heybl & Philpott

(57) ABSTRACT

A solid state lighting fixture with an integrated driver circuit. A housing has a base end and an open end through which light is emitted from the fixture. The reflective interior surface of the fixture and the base define an optical chamber. At least one, and often multiple, light sources are mounted at the fixture base along with the circuitry necessary to drive and/or control the light sources. The drive circuit and the light sources are both located in the optical chamber. A reflective cone fits within the optical chamber such that it covers most of the drive circuit and other components at the base of fixture that might absorb light. The reflective cone is shaped to define a hole that is aligned with the light sources so that light may be emitted through the hole toward the open end of the fixture.

27 Claims, 7 Drawing Sheets

(51) Int. Cl.

| | |
|---|---|
| ***F21V 7/04*** | (2006.01) |
| ***F21V 3/04*** | (2006.01) |
| ***F21V 7/00*** | (2006.01) |
| *F21V 23/02* | (2006.01) |
| *F21S 8/04* | (2006.01) |
| *F21V 3/02* | (2006.01) |
| *F21V 7/22* | (2006.01) |
| *F21V 21/04* | (2006.01) |
| *F21V 23/00* | (2015.01) |
| *F21Y 101/02* | (2006.01) |
| *H05B 33/08* | (2006.01) |
| *F21V 29/15* | (2015.01) |

(56) References Cited

U.S. PATENT DOCUMENTS

| | | | | |
|---|---|---|---|---|
| 2,675,466 | A | 4/1954 | Frederick | |
| 3,302,918 | A | 2/1967 | Cohen | |
| 3,381,124 | A | 4/1968 | Eisenberg | 362/354 |
| 4,044,246 | A | 8/1977 | Docimo | |
| 4,302,798 | A | 11/1981 | Sit | |
| 4,939,627 | A | 7/1990 | Herst et al. | 362/299 |
| 5,025,356 | A | 6/1991 | Gawad | 362/221 |
| 5,546,291 | A | 8/1996 | Simes | |
| 5,823,663 | A | 10/1998 | Bell et al. | 362/362 |
| D407,473 | S | 3/1999 | Wimbock | D23/328 |
| 6,127,783 | A | 10/2000 | Marshall et al. | |
| 6,149,283 | A | 11/2000 | Conway et al. | 362/236 |
| 6,155,699 | A | 12/2000 | Miller et al. | 362/293 |
| 6,210,025 | B1 | 4/2001 | Schmidt et al. | 362/362 |
| 6,234,643 | B1 | 5/2001 | Lichon, Jr. | 362/147 |
| 6,402,347 | B1 | 6/2002 | Maas et al. | 362/294 |
| 6,443,598 | B1 | 9/2002 | Morgan | 362/342 |
| 6,523,974 | B2 | 2/2003 | Engel | 362/224 |
| 6,545,216 | B1 | 4/2003 | Bell et al. | |
| 6,578,979 | B2 | 6/2003 | Truttmann-Battig | 362/92 |
| D496,121 | S | 9/2004 | Santoro | D26/74 |
| 6,871,983 | B2 | 3/2005 | Jacob et al. | 362/364 |
| 6,948,840 | B2 | 9/2005 | Grenda et al. | 362/555 |
| 7,021,797 | B2 | 4/2006 | Minano et al. | 362/355 |
| 7,025,477 | B2 | 4/2006 | Blessing | |
| 7,049,761 | B2 | 5/2006 | Timmermans et al. | 315/246 |
| 7,063,449 | B2 | 6/2006 | Ward | 345/102 |
| 7,102,172 | B2 | 9/2006 | Lynch | |
| 7,125,146 | B2 | 10/2006 | Willis | |
| 7,175,296 | B2 | 2/2007 | Cok | 362/147 |
| 7,213,940 | B1 | 5/2007 | Van de Ven et al. | 362/231 |
| 7,217,004 | B2 | 5/2007 | Park et al. | 362/240 |
| 7,237,924 | B2 | 7/2007 | Martineau et al. | 362/231 |
| D556,358 | S | 11/2007 | Santoro | D26/74 |
| 7,338,182 | B1 | 3/2008 | Hastings et al. | 362/150 |
| 7,374,327 | B2 | 5/2008 | Schexnaider | |
| 7,510,299 | B2 | 3/2009 | Timmermans et al. | 362/225 |
| 7,520,636 | B2 | 4/2009 | Van der Poel | 362/290 |
| D593,246 | S | 5/2009 | Fowler et al. | D26/76 |
| 7,559,672 | B1 | 7/2009 | Parkyn et al. | 362/244 |
| 7,594,736 | B1 | 9/2009 | Kassay et al. | 362/223 |
| D604,446 | S | 11/2009 | Fowler et al. | D26/76 |
| 7,614,769 | B2 | 11/2009 | Sell | |
| 7,618,157 | B1 | 11/2009 | Galvez et al. | 362/294 |
| 7,618,160 | B2 | 11/2009 | Chinniah et al. | 362/326 |
| D608,932 | S | 1/2010 | Castelli | D26/76 |
| 7,654,702 | B1 | 2/2010 | Ding et al. | 362/294 |
| 7,661,844 | B2 | 2/2010 | Sekiguchi et al. | 362/249 |
| D611,183 | S | 3/2010 | Duarte | D26/76 |
| 7,670,021 | B2 | 3/2010 | Chou | |
| 7,674,005 | B2 | 3/2010 | Chung et al. | 362/223 |
| 7,686,470 | B2 | 3/2010 | Chiang | 362/147 |
| 7,686,484 | B2 | 3/2010 | Heiking et al. | 362/375 |
| 7,712,918 | B2 | 5/2010 | Siemiet et al. | 362/241 |
| 7,722,220 | B2 | 5/2010 | Van de Ven | 362/294 |
| 7,722,227 | B2 * | 5/2010 | Zhang et al. | 362/364 |
| D617,487 | S | 6/2010 | Fowler et al. | D26/76 |
| 7,768,192 | B2 | 8/2010 | Van de Ven et al. | 313/503 |
| 7,771,085 | B2 | 8/2010 | Kim | |
| 7,794,114 | B2 | 9/2010 | Medendorp | |
| 7,810,736 | B2 | 10/2010 | Smith | |
| 7,815,338 | B2 | 10/2010 | Siemiet et al. | 362/218 |
| 7,824,056 | B2 | 11/2010 | Madireddi et al. | 362/125 |
| 7,828,465 | B2 | 11/2010 | Roberge et al. | |
| 7,828,468 | B2 | 11/2010 | Mayfield et al. | 362/342 |
| 7,854,616 | B2 | 12/2010 | Janos | |
| D633,247 | S | 2/2011 | Kong et al. | D26/88 |
| 7,906,793 | B2 | 3/2011 | Negley | |
| 7,918,591 | B2 | 4/2011 | Lynch | |
| 7,922,354 | B2 | 4/2011 | Everhart | 362/235 |
| 7,926,982 | B2 | 4/2011 | Liu | 362/294 |
| 7,950,832 | B2 | 5/2011 | Tanaka | |
| 7,980,736 | B2 | 7/2011 | Soderman | |
| 7,988,321 | B2 | 8/2011 | Wung et al. | 362/218 |
| 7,988,335 | B2 | 8/2011 | Liu et al. | 362/294 |
| 7,991,257 | B1 | 8/2011 | Coleman | 264/1.24 |
| 7,993,034 | B2 * | 8/2011 | Wegner | 362/296.05 |
| 7,997,762 | B2 | 8/2011 | Wang et al. | 362/249 |
| 8,022,641 | B2 | 9/2011 | Janik | |
| 8,038,314 | B2 | 10/2011 | Ladewig | |
| 8,038,321 | B1 | 10/2011 | Franck et al. | 362/249.02 |
| 8,070,326 | B2 | 12/2011 | Lee | 362/307 |
| D653,376 | S | 1/2012 | Kong et al. | D26/76 |
| 8,092,042 | B2 | 1/2012 | Wilcox | |
| 8,092,043 | B2 | 1/2012 | Lin et al. | 362/249.02 |
| 8,092,049 | B2 | 1/2012 | Kinnune et al. | 362/294 |
| 8,096,671 | B1 | 1/2012 | Cronk | 362/147 |
| D657,488 | S | 4/2012 | Lown et al. | D26/120 |
| 8,162,504 | B2 | 4/2012 | Zhang et al. | 362/217 |
| 8,186,855 | B2 | 5/2012 | Wassel et al. | 362/373 |
| 8,197,086 | B2 | 6/2012 | Watanabe et al. | 362/218 |
| 8,201,968 | B2 | 6/2012 | Maxik et al. | |
| 8,215,799 | B2 | 7/2012 | Vanden Eynden et al. | 362/294 |
| 8,232,739 | B2 | 7/2012 | Underwood | |
| 8,246,203 | B2 | 8/2012 | Hancock | |
| 8,246,219 | B2 | 8/2012 | Teng et al. | 362/311.03 |
| 8,256,919 | B2 | 9/2012 | Holder | |
| 8,256,927 | B2 | 9/2012 | Hu et al. | 362/294 |
| D670,849 | S | 11/2012 | Lay et al. | D26/74 |
| 8,317,354 | B2 | 11/2012 | Gassner et al. | 362/147 |
| D679,848 | S | 4/2013 | Pickard et al. | D26/74 |
| 8,410,514 | B2 | 4/2013 | Kim | 257/99 |
| D684,291 | S * | 6/2013 | Goelz et al. | D26/74 |
| 8,480,252 | B2 | 7/2013 | Bertram et al. | 362/243 |
| 8,506,135 | B1 | 8/2013 | Oster | 362/373 |
| 8,591,058 | B2 * | 11/2013 | Concepcion | 362/231 |
| 8,591,071 | B2 | 11/2013 | Hochstein | 362/294 |
| D698,975 | S | 2/2014 | Blessitt et al. | D26/74 |
| 8,641,243 | B1 * | 2/2014 | Rashidi | 362/373 |
| D701,988 | S | 4/2014 | Clements | D26/74 |
| 8,696,154 | B2 | 4/2014 | Hutchens | 362/217.05 |
| 8,702,264 | B1 | 4/2014 | Rashidi | 362/147 |
| 8,764,244 | B2 | 7/2014 | Jeon | 362/218 |
| D714,988 | S | 10/2014 | Park et al. | D26/74 |
| D721,198 | S | 1/2015 | Glasbrenner | D26/76 |
| 9,052,075 | B2 | 6/2015 | Demuynck et al. | |
| 2004/0001344 | A1 | 1/2004 | Hecht | 362/555 |
| 2004/0085779 | A1 | 5/2004 | Pond et al. | 362/516 |
| 2004/0240230 | A1 | 12/2004 | Kitajima | 362/558 |
| 2005/0264716 | A1 | 12/2005 | Kim et al. | |
| 2005/0281023 | A1 | 12/2005 | Gould | 362/217 |
| 2006/0077684 | A1 | 4/2006 | Yuen | |
| 2006/0221611 | A1 | 10/2006 | No | 362/247 |
| 2006/0262521 | A1 | 11/2006 | Piepgras et al. | 362/149 |
| 2006/0291206 | A1 | 12/2006 | Angelini et al. | 362/244 |
| 2007/0041220 | A1 | 2/2007 | Lynch | |
| 2007/0070625 | A1 | 3/2007 | Bang | 362/240 |
| 2007/0109779 | A1 | 5/2007 | Sekiguchi et al. | |
| 2007/0115670 | A1 | 5/2007 | Roberts et al. | |
| 2007/0115671 | A1 | 5/2007 | Roberts et al. | |
| 2007/0211457 | A1 | 9/2007 | Mayfield et al. | 362/223 |
| 2007/0230172 | A1 | 10/2007 | Wang | |
| 2007/0253205 | A1 | 11/2007 | Welker | 362/373 |
| 2007/0297181 | A1 | 12/2007 | Mayfield et al. | 362/342 |
| 2008/0019147 | A1 | 1/2008 | Erchak | 362/607 |
| 2008/0049422 | A1 | 2/2008 | Trenchard et al. | 362/238 |
| 2008/0122364 | A1 | 5/2008 | McClellan | |

(56) References Cited

U.S. PATENT DOCUMENTS

| | | | | |
|---|---|---|---|---|
| 2008/0170398 | A1 | 7/2008 | Kim | |
| 2008/0232093 | A1 | 9/2008 | Kim | 362/147 |
| 2008/0232116 | A1 | 9/2008 | Kim | |
| 2008/0278943 | A1 | 11/2008 | Van Der Poel | 362/240 |
| 2009/0034247 | A1 | 2/2009 | Boyer | 362/225 |
| 2009/0073693 | A1 | 3/2009 | Nall | 362/249.02 |
| 2009/0161356 | A1* | 6/2009 | Negley et al. | 362/231 |
| 2009/0168439 | A1 | 7/2009 | Chiang | 362/404 |
| 2009/0196024 | A1 | 8/2009 | Heiking et al. | 362/150 |
| 2009/0225543 | A1 | 9/2009 | Jacobson et al. | |
| 2009/0237958 | A1 | 9/2009 | Kim | |
| 2009/0262543 | A1 | 10/2009 | Ho | 362/373 |
| 2009/0296388 | A1 | 12/2009 | Wu et al. | 362/235 |
| 2009/0310354 | A1 | 12/2009 | Zampini et al. | 362/235 |
| 2009/0323334 | A1 | 12/2009 | Roberts et al. | |
| 2010/0061108 | A1* | 3/2010 | Zhang et al. | 362/364 |
| 2010/0097794 | A1 | 4/2010 | Teng et al. | 362/231 |
| 2010/0103678 | A1 | 4/2010 | Van de Ven et al. | 362/294 |
| 2010/0110679 | A1 | 5/2010 | Teng et al. | |
| 2010/0172133 | A1 | 7/2010 | Liu | 362/235 |
| 2010/0177532 | A1 | 7/2010 | Simon et al. | 362/555 |
| 2010/0188609 | A1 | 7/2010 | Matsuki et al. | |
| 2010/0253591 | A1 | 10/2010 | Hwu et al. | 345/1.3 |
| 2010/0254128 | A1* | 10/2010 | Pickard et al. | 362/231 |
| 2010/0254145 | A1 | 10/2010 | Yamaguchi | |
| 2010/0254146 | A1 | 10/2010 | McCanless | |
| 2010/0270903 | A1* | 10/2010 | Jao et al. | 313/46 |
| 2010/0271843 | A1 | 10/2010 | Holten et al. | 362/609 |
| 2010/0277905 | A1* | 11/2010 | Janik et al. | 362/235 |
| 2010/0295468 | A1 | 11/2010 | Pederson et al. | 315/294 |
| 2010/0327768 | A1 | 12/2010 | Kong et al. | 315/294 |
| 2011/0032714 | A1 | 2/2011 | Chang | 362/373 |
| 2011/0043132 | A1 | 2/2011 | Kim et al. | 362/235 |
| 2011/0090671 | A1 | 4/2011 | Bertram et al. | 362/84 |
| 2011/0141722 | A1 | 6/2011 | Acampora et al. | 362/218 |
| 2011/0141734 | A1 | 6/2011 | Li et al. | 362/235 |
| 2011/0156584 | A1 | 6/2011 | Kim | 315/32 |
| 2011/0164417 | A1 | 7/2011 | Huang | 362/235 |
| 2011/0175533 | A1 | 7/2011 | Homan | 315/130 |
| 2011/0199005 | A1 | 8/2011 | Bretschneider et al. | |
| 2011/0199769 | A1 | 8/2011 | Bretschneider et al. | |
| 2011/0246146 | A1 | 10/2011 | Kauffman et al. | 703/2 |
| 2011/0255292 | A1 | 10/2011 | Shen | 362/311 |
| 2011/0267810 | A1 | 11/2011 | Higman et al. | 362/218 |
| 2011/0267823 | A1 | 11/2011 | Angelini et al. | 362/277 |
| 2011/0305024 | A1 | 12/2011 | Chang | 362/294 |
| 2012/0033420 | A1 | 2/2012 | Kim et al. | 362/235 |
| 2012/0038289 | A1 | 2/2012 | Jee et al. | 315/291 |
| 2012/0051041 | A1 | 3/2012 | Edmond et al. | 362/231 |
| 2012/0127714 | A1 | 5/2012 | Rehn | |
| 2012/0134146 | A1 | 5/2012 | Smith | 362/225 |
| 2012/0140442 | A1* | 6/2012 | Woo et al. | 362/95 |
| 2012/0140464 | A1 | 6/2012 | Huang et al. | |
| 2013/0235568 | A1 | 9/2013 | Green et al. | 362/218 |
| 2013/0258652 | A1 | 10/2013 | Hsieh | 362/225 |
| 2013/0277643 | A1* | 10/2013 | Williamson | H01L 27/156 257/13 |
| 2014/0265930 | A1 | 9/2014 | Harris | 315/307 |
| 2015/0016100 | A1 | 1/2015 | Ishii | 362/223 |

FOREIGN PATENT DOCUMENTS

| | | | |
|---|---|---|---|
| CN | 1963289 | A | 5/2007 |
| CN | 101188261 | | 5/2008 |
| CN | 201069133 | | 6/2008 |
| CN | 101660715 | | 3/2010 |
| CN | 101776254 | | 7/2010 |
| CN | 101790660 | | 7/2010 |
| CN | 102072443 | | 5/2011 |
| CN | 202580962 | | 12/2012 |
| DE | 102007030186 | | 1/2009 |
| DE | 202010001832 | | 7/2010 |
| EP | 1298383 | A2 | 4/2003 |
| EP | 1357335 | A2 | 10/2003 |
| EP | 1653254 | | 3/2006 |
| EP | 1737051 | | 12/2006 |
| EP | 1847762 | A2 | 10/2007 |
| EP | 1860467 | | 11/2007 |
| EP | 1950491 | | 7/2008 |
| EP | 2636945 | A2 | 9/2013 |
| JP | 2002244027 | | 11/2002 |
| JP | U30972327 | | 8/2003 |
| JP | 2004140327 | | 5/2004 |
| JP | 2004345615 | | 12/2004 |
| JP | 2006173624 | | 6/2006 |
| JP | 2009295577 | | 12/2009 |
| JP | 2010103687 | | 5/2010 |
| JP | 2011018571 | | 8/2011 |
| JP | 2011018572 | | 8/2011 |
| TW | 201018826 | | 5/2010 |
| WO | WO03102467 | | 12/2003 |
| WO | WO2006105346 | | 3/2006 |
| WO | WO2007099860 | | 9/2007 |
| WO | WO2009030233 | | 3/2009 |
| WO | WO2009140761 | A1 | 11/2009 |
| WO | 2009157999 | | 12/2009 |
| WO | WO2009157999 | A1 | 12/2009 |
| WO | 2010024583 | | 3/2010 |
| WO | WO2010042216 | | 4/2010 |
| WO | WO2010042216 | A2 | 4/2010 |
| WO | WO2011074424 | A1 | 6/2011 |
| WO | WO2011096098 | A1 | 8/2011 |
| WO | WO2011098191 | | 8/2011 |
| WO | WO2011118991 | A2 | 9/2011 |
| WO | WO2011140353 | A2 | 11/2011 |
| WO | WO 03102467 | | 12/2013 |

OTHER PUBLICATIONS

XLamp®M family from Cree®, Inc., Product Family Data Sheet, 14 pages.

XLamp®X family from Cree®, Inc., Product Family Data Sheet, 17 pages.

Energy Star® Program Requirements for Solid State Lighting Luminaires, Eligibility Criteria—Version 1.1, final: Dec. 19, 2008.

Assist Recommends . . . LED Life for General Lighting: Definition of Life, vol. 1, Issue 1, Feb. 2005.

"IES Approved Method for Measuring Lumen Maintenance of LED light Sources", Sep. 22, 2008. ISBN No. 978-0-87995-227-3, (LM-80).

U.S. Appl. No. 13/649,052, filed Oct. 10, 2012, Lowes, et al.

U.S. Appl. No. 13/649,067, filed Oct. 10, 2012, Lowes, et al.

U.S. Appl. No. 13/207,204, filed Aug. 10, 2011, Athalye, et al.

U.S. Appl. No. 13/365,844.

U.S. Appl. No. 13/662,618, filed Oct. 29, 2012.

U.S. Appl. No. 13/462,388, filed May 2, 2012.

Notice to Submit a Response from Korean Patent Application No. 30-2011-0038115, dated Dec. 12, 2012.

Notice to Submit a Response from Korean Patent Application No. 30-2011-0038116, dated Dec. 12, 2012.

International Search Report and Written Opinion for PCT Application No. PCT/US2011/062396, dated Jul. 13, 2012.

Office Action from Japanese Design Patent Application No. 2011-18570.

Reason for Rejection from Japanese Design Patent Application No. 2011-18571.

Reason for Rejection from Japanese Design Patent Application No. 2011-18572.

U.S. Appl. No. 12/873,303, filed Aug. 31, 2010 to Edmond, et al.

U.S. Appl. No. 12/961,385, filed Dec. 6, 2010 to Pickard, et al.

Cree's XLamp XP-E LED's, data sheet, pp. 1-16.

Cree's XLamp XP-G LED's, data sheet, pp. 1-12.

International Search Report and Written Opinion for Patent Application No. PCT/US2011/001517, dated: Feb. 27, 2012.

U.S. Appl. No. 12/418,796, filed Apr. 6, 2009.

U.S. Appl. No. 13/429,080, filed Mar. 23, 2012.

U.S. Appl. No. 13/028,946, filed Feb. 16, 2011.

U.S. Appl. No. 13/306,589, filed Nov. 29, 2011.

Office Action from U.S. Appl. No. 13/429,080, dated Apr. 18, 2014.

Office Action from U.S. Appl. No. 12/961,385, dated Mar. 11, 2014.

(56) References Cited

OTHER PUBLICATIONS

International Search Report and Written Opinion from PCT Application No. PCT/US2013/021053, dated Apr. 17, 2013.
Final Rejection issued in Korean Design Appl. No. 30-2011-0038114, dated Jun. 14, 2013.
Final Rejection issued in Korean Design Appl. No. 30-2011-0038115, dated Jun. 14, 2013.
Final Rejection issued in Korean Design Appl. No. 30-2011-0038116, dated Jun. 17, 2013.
International Search Report and Written Opinion from PCT Patent Appl. No. PCT/US2013/035668, dated Jul. 12, 2013.
Communication from European Patent Appl. No. 13701525.1-1757, dated Sep. 26, 2014.
Decision of Rejection from Japanese Appl. No. 2013-543207, dated Nov. 25, 2014.
Office Action from Mexican Appl. No. 100881, dated Nov. 28, 2014.
Grant Notice from European Appl. No. 13701525.1-1757, dated Nov. 24, 2014.
Preliminary Report on Patentability from PCT/US2013/035668, dated Oct. 14, 2014.
Office Action from U.S. Appl. No. 13/442,746, dated Sep. 15, 2014.
Office Action from U.S. Appl. No. 13/429,080, dated Sep. 16, 2014.
Office Action from U.S. Appl. No. 13/844,431, dated Oct. 10, 2014.
Office Action from U.S. Appl. No. 13/443,630, dated Oct. 10, 2014.
Office Action from U.S. Appl. No. 13/368,217, dated Oct. 22, 2014.
Office Action from U.S. Appl. No. 12/961,385, dated Nov. 6, 2014.
Office Action from U.S. Appl. No. 13/453,924, dated Nov. 7, 2014.
Gary Steffy, "Architectural Lighting Design"ThirdEdition, Published by John Wiley & Sons, Inc.
Catalog Page for MFORCE, Matsushita Electric Works/Panasonic.
Sybil P. Parker, "Concise Encyclopedia of Science & Technology" Forth Edition, McGraw-Hill.
LEDs Magazine, Issue 18 Jan./Feb. 2008.
Lighting Answers, LED Lighting Systems, vol. 2, Issue 3, May 2003.
Matsushita MFOURCE Specification Sheet NNN20605, Matsushita Electric Works/Panasonic.
Matsushita MFOURCE Specification Sheet NNN20608, Matsushita Electric Works/Panasonic.
Sea Gull Lighting Brochure, Dec. 21, 2009, Sea Gull Lighting/Generation Brands.
Silescent 100i LV Light Product Specification Sheet, Sea Gull Lighting/Generations Brand.
Philips eW Downlight Powercore Product, Philips Color Kinetics.
Lighting Design & Installation: Techniques & Projects for Lighting Your Home and Landscape.
2009 NGL Showcase, Dec. 3-4, 2009; IES/IALD/US Dept. of Energy.
International Search Report and Written Opinion from Appl. No. PCT/CN2013/072772, dated Dec. 19, 2013.
Preliminary Report and Written Opinion from PCT appl No. PCT/US2012/047084, dated Feb. 6, 2014.
Reasons for Rejection from Japanese Patent Appl. No. 2013-543207, dated May 20, 2014.
First Office Action from Chinese Patent Appl. No. 2011800529984, dated May 4, 2014.
Office Action from U.S. Appl. No. 13/544,662, dated May 5, 2014.
Office Action from U.S. Appl. No. 13/844,431, dated May 15, 2014.
Office Action from U.S. Appl. No. 13/341,741, dated Jun. 6, 2014.
Office Action from U.S. Appl. No. 29/387,171, dated May 2, 2012.
Response to OA from U.S. Appl. No. 29/387,171, filed Aug. 2, 2012.
Office Action from U.S. Appl. No. 12/961,385, dated Apr. 26, 2013.
Response to OA from U.S. Appl. No. 12/961,385, filed Jul. 24, 2013.
Office Action from U.S. Appl. No. 13/464,745. dated Jul. 16, 2013.
Office Action from U.S. Appl. No. 29/368,970, dated Jun. 19, 2012.
Office Action from U.S. Appl. No. 29/368,970, dated Aug. 24, 2012.
Response to OA from U.S. Appl. No. 29/368,970, filed Nov. 26, 2012.
Search Report and Written Opinion from PCT Patent Appl. No. PCT/US2012/047084, dated Feb. 27, 2013.
Search Report and Written Opinion from PCT Patent Appl. No. PCT/US2012/071800, dated Mar. 25, 2013.
International Preliminary Report on Patentabiliby from PCT/US2012/071800 dated Jul. 10, 2014.
Office Action from U.S. Appl. No. 13/189,535, dated Jun. 20, 2014.
Office Action from U.S. Appl. No. 13/453,924, dated Jun. 25, 2014.
Office Action from U.S. Appl. No. 13/443,630, dated Jul. 1, 2014.
Office Action from U.S. Appl. No. 13/464,745, dated Feb. 12, 2014.
Office Action from U.S. Appl. No. 13/453,924, dated Feb. 19, 2014.
Office Action from U.S. Appl. No. 13/341,741, dated Jan. 14, 2014.
Office Action from U.S. Appl. No. 13/370,252, dated Dec. 20, 2013.
Office Action from U.S. Appl. No. 13/464,745, dated Jul. 16, 2014.
International Preliminary Report on Patentability and Written Opinion from PCT/US2013/021053, dated Aug. 21, 2014.
"PIER Lighting Research Program Project 2,3 Low-profile LED Luminaries"; by Narendran. et al., Apr. 2007. Lighting Research Center. California Energy Commission, pp. 1-70.
Philips eW Downlight Powercore Retailer Guide, Copyright 2009; Philips Solid-State Lighting Solutions, Inc. pp. 1-16.
Inteltech Corp. Silescent 100i LV light Specs: May 2008; 2 pgs.
Specification sheets for Cree LR6, 2012; 2 pgs.
Cree LED Lighting Catalog 2013; 148 pgs.
Installation Instructions for Cree LR6, 2013; 2 pgs.
Matsushita Electric Works, Ltd. Annual Report, 2007: Jun. 30, 2007, Matsushita Electric Works/Panasonic; 2 pgs.
Controlling LED lighting systems: Introducing the LED driver 2004: Craig DiLouie, LED's Magazine; 22 pgs.
Luminaires, A Pacific Energy Center Factsheet 1997; 7 pgs.
Sea Gull Lighting Installation Instructions. www.seagullighting.com/pics/pdf/InstructionsShoots/HC-387.pdf.
International Search Report and Written Opinion from PCT/US2013/049225, dated Oct. 24, 2013.
Notice of Completion of Pretrial Re-examination from Japanese Patent appl. No. 2013-543207, dated Jun. 30, 2015.
Pretrial Report from Japanese Appl. No. 2013-543207, dated Jun. 19, 2015.
Decision of Rejection from Chinese Patent Appl. No. 201180052998.4, dated Jul. 16, 2015.
Office Action from U.S. Appl. No. 12/873,303, dated Jun. 22, 2015.
Response to OA from U.S. Appl. No. 12/873,303, filed Aug. 21, 2015.
Office Action from U.S. Appl. No. 13/341,741, dated Jun. 22, 2015.
Office Action from U.S. Appl. No. 13/443,630, dated Jun. 23, 2015.
Response to OA from U.S. Appl. No. 13/443,630, filed Aug. 21, 2015.
Office Action from U.S. Appl. No. 13/189,535, dated Jul. 14, 2015.
Office Action from U.S. Appl. No. 13/453,924, dated Jul. 21, 2015.
Office Action from U.S. Appl. No. 13/442,746, dated Jul. 27, 2015.
Office Action from U.S. Appl. No. 14/020,757, dated Aug. 3, 2015.
Office Action from U.S. Appl. No. 13/429,080, dated Sep. 1, 2015.
Office Action from U.S. Appl. No. 14/716,480, dated Sep. 24, 2015.
Office Action from U.S. Appl. No. 14/170,627, dated Oct. 5, 2015.
Office Action from U.S. Appl. No. 13/368,217, dated Oct. 8, 2015.
Office Action from U.S. Appl. No. 13/464,745, dated Oct. 8, 2015.
Office Action from U.S. Appl. No. 29/466,391, dated Oct. 14, 2015.
First Office Action from Chinese Patent Appl. No. 2012800369142, dated Mar. 26, 2015.
Office Action from U.S. Appl. No. 13/464,745, dated Apr. 2, 2015.
Office Action from U.S. Appl. No. 13/442,746, dated Apr. 28, 2015.
Office Action from U.S. Appl. No. 13/368,217, dated May 13, 2015.
Office Action from U.S. Appl. No. 13/828,348, dated May 27, 2015.
Office Action from U.S. Appl. No. 13/429,080, dated Feb. 18, 2015.
Office Action from U.S. Appl. No. 13/453,924, dated Mar. 10, 2015.
First Official Action from European Patent Appl. No. 12 743 003.1-1757, dated Jan. 16, 2015.
Second Office Action and Search Report from Chinese Appl. No. 2011800529984, dated Dec. 26, 2014.
Grant Notice from European Appl. No. 13701525.1, dated Nov. 19, 2014.
International Report and Written Opinion from PCT/US2013/049225, dated Jan. 22, 2015.
Office Action from U.S. Appl. No. 13/828,348, dated Nov. 20, 2014.
Office Action from U.S. Appl. No. 12/873,303, dated Nov. 28, 2014.

(56) References Cited

OTHER PUBLICATIONS

Office Action from U.S. Appl. No. 13/464,745, dated Dec. 10, 2014.
Office Action from U.S. Appl. No. 13/341,741, dated Dec. 24, 2014.
Office Action from U.S. Appl. No. 13/189,535, dated Jan. 13, 2015.
Office Action from U.S. Appl. No. 12/961,385, dated Nov. 27, 2015.
Office Action from U.S. Appl. No. 13/828.348, dated Nov. 4. 2015.
Office Action from U.S. Appl. No. 14/020.757, dated Nov. 24, 2014.
First Office Action from Chinese Patent Appl. No. 2011800588770, dated Sep. 25. 2015.

* cited by examiner

FIG. 1
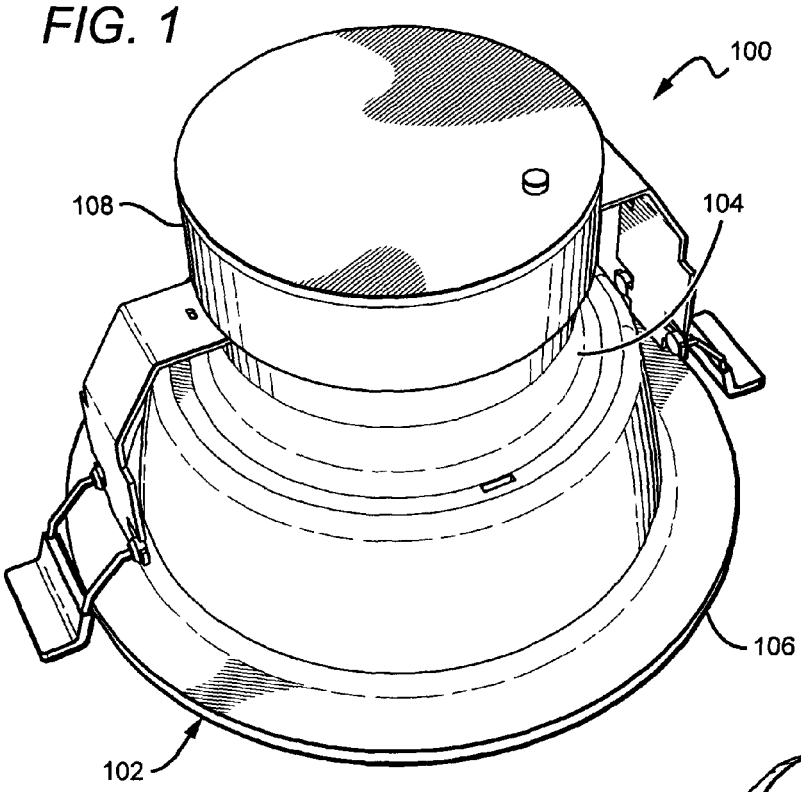
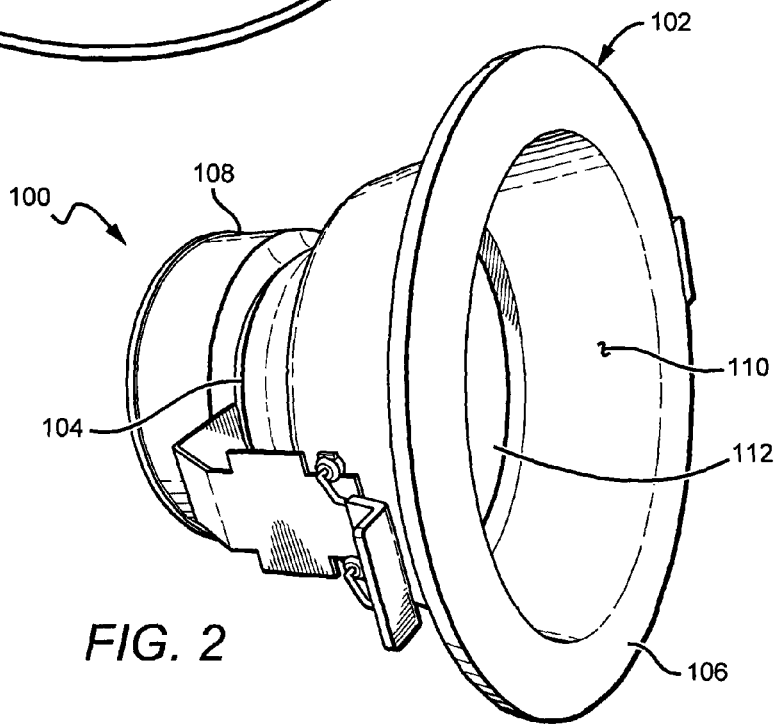
FIG. 2

FIG. 7
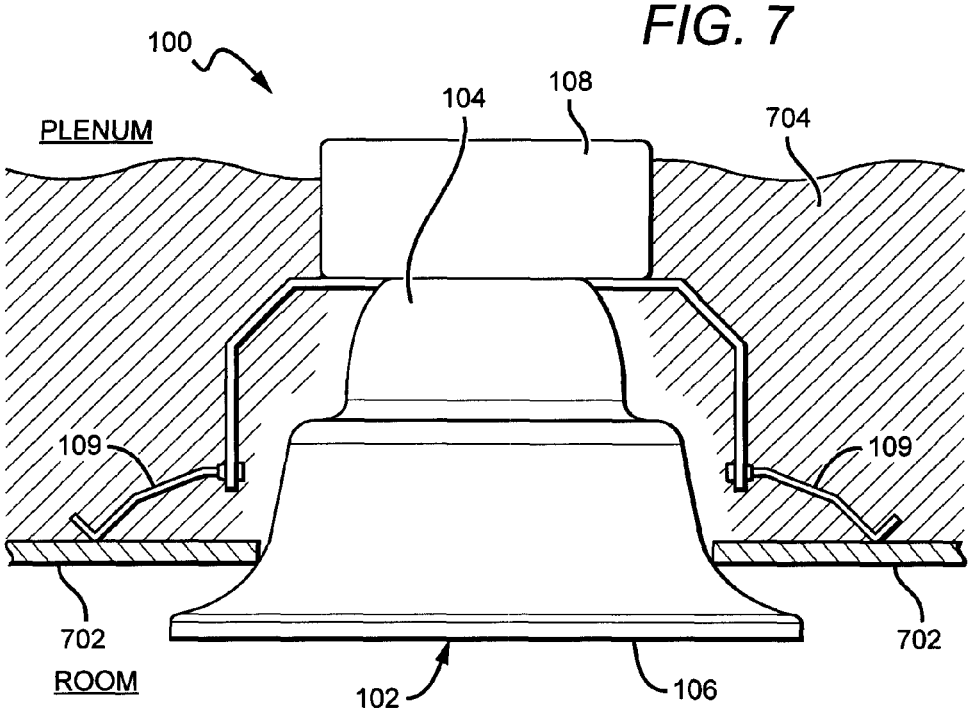
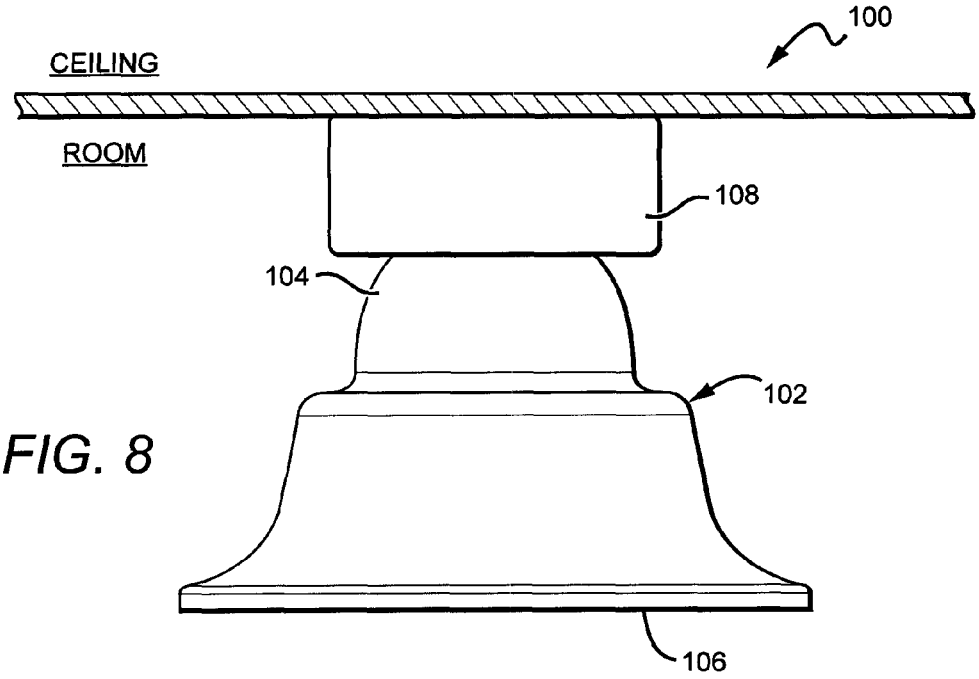
FIG. 8

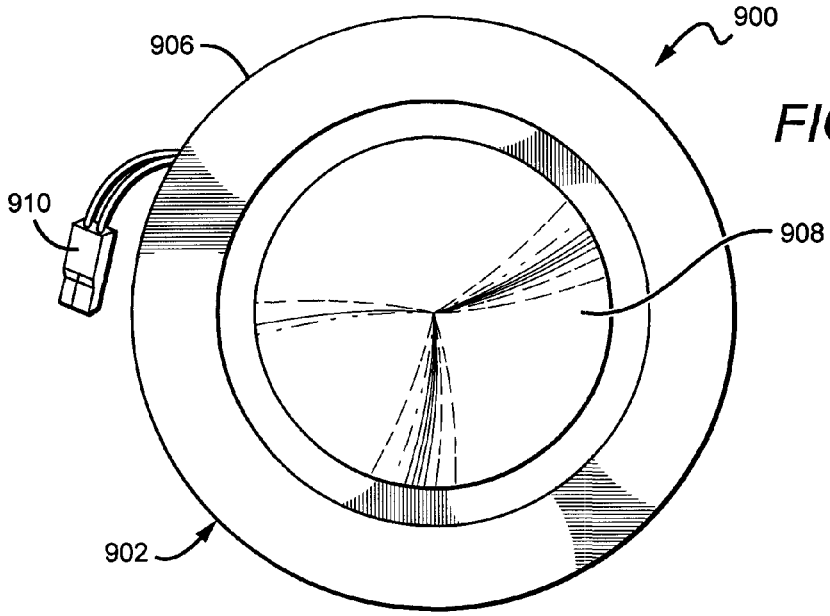
FIG. 9
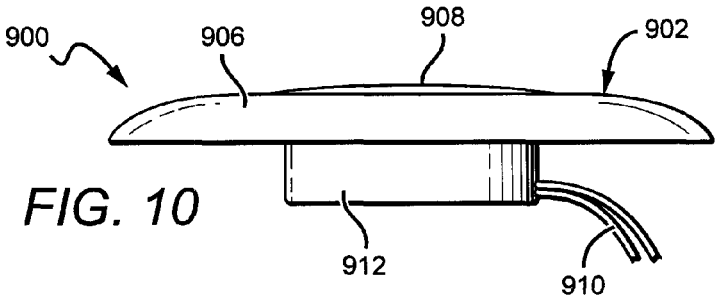
FIG. 10
FIG. 11
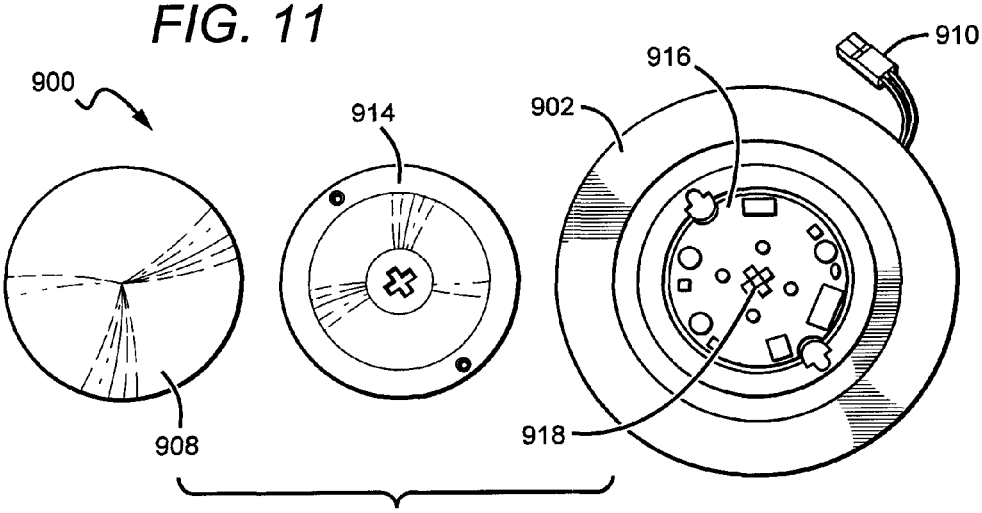

LED FIXTURE WITH INTEGRATED DRIVER CIRCUITRY

RELATED APPLICATIONS

The present application is a continuation-in-part of U.S. patent application Ser. No. 13/429,080, filed on 23 Mar. 2012. The present application claims the benefit of U.S. Prov. App. Ser. No. 61/672,020, filed on 16 Jul. 2012 and U.S. Prov. App. Ser. No. 61/676,310 filed 26 Jul. 2012. The contents of these three applications are hereby incorporated by reference as if set forth fully herein.

BACKGROUND OF THE INVENTION

1. Field of the Invention

The subject matter herein relates to solid state lighting (SSL) fixtures and, more particularly, to SSL fixtures having integrated driver circuitry.

2. Description of the Related Art

There is an ongoing effort to develop systems that are more energy-efficient. A large proportion (some estimates are as high as twenty-five percent) of the electricity generated in the United States each year goes to lighting, a large portion of which is general illumination (e.g., downlights, flood lights, spotlights and other general residential or commercial illumination products). Accordingly, there is an ongoing need to provide lighting that is more energy-efficient.

Solid state light emitters (e.g., light emitting diodes) are receiving much attention due to their energy efficiency. It is well known that incandescent light bulbs are very energy-inefficient light sources; about ninety percent of the electricity they consume is released as heat rather than light. Fluorescent light bulbs are more efficient than incandescent light bulbs but are still less efficient than solid state light emitters, such as light emitting diodes.

LEDs and other solid state light emitters may be energy efficient, so as to satisfy ENERGY STAR® program requirements. ENERGY STAR program requirements for LEDs are defined in "ENERGY STAR® Program Requirements for Solid State Lighting Luminaires, Eligibility Criteria—Version 1.1", Final: Dec. 19, 2008, the disclosure of which is hereby incorporated herein by reference in its entirety as if set forth fully herein.

In addition, as compared to the normal lifetimes of solid state light emitters, e.g., light emitting diodes, incandescent light bulbs have relatively short lifetimes, i.e., typically about 750-1000 hours. In comparison, light emitting diodes, for example, have typical lifetimes between 50,000 and 70,000 hours. Fluorescent bulbs have longer lifetimes than incandescent lights (e.g., fluorescent bulbs typically have lifetimes of 10,000-20,000 hours), but provide less favorable color reproduction. The typical lifetime of conventional fixtures is about 20 years, corresponding to a light-producing device usage of at least about 44,000 hours (based on usage of 6 hours per day for 20 years). Where the light-producing device lifetime of the light emitter is less than the lifetime of the fixture, the need for periodic change-outs is presented. The impact of the need to replace light emitters is particularly pronounced where access is difficult (e.g., vaulted ceilings, bridges, high buildings, highway tunnels) and/or where change-out costs are extremely high.

LED lighting systems can offer a long operational lifetime relative to conventional incandescent and fluorescent bulbs. LED lighting system lifetime is typically measured by an "L70 lifetime", i.e., a number of operational hours in which the light output of the LED lighting system does not degrade by more than 30%. Typically, an L70 lifetime of at least 25,000 hours is desirable, and has become a standard design goal. As used herein, L70 lifetime is defined by Illuminating Engineering Society Standard LM-80-08, entitled "*IES Approved Method for Measuring Lumen Maintenance of LED Light Sources*", Sep. 22, 2008, ISBN No. 978-0-87995-227-3, also referred to herein as "LM-80", the disclosure of which is hereby incorporated herein by reference in its entirety as if set forth fully herein, and/or using the lifetime projections found in the ENERGY STAR Program Requirements cited above or described by the ASSIST method of lifetime prediction, as described in "*ASSIST Recommends . . . LED Life For General Lighting: Definition of Life*", Volume 1, Issue 1, February 2005, the disclosure of which is hereby incorporated herein by reference as if set forth fully herein.

Heat is a major concern in obtaining a desirable operational lifetime for solid state light emitters. As is well known, an LED also generates considerable heat during the generation of light. The heat is generally measured by a "junction temperature", i.e., the temperature of the semiconductor junction of the LED. In order to provide an acceptable lifetime, for example, an L70 of at least 25,000 hours, it is desirable to ensure that the junction temperature should not be above 85° C. In order to ensure a junction temperature that is not above 85° C., various heat sinking schemes have been developed to dissipate at least some of the heat that is generated by the LED. See, for example, Application Note: CLD-APO6.006, entitled *Cree® XLamp® XR Family* & 4550 *LED Reliability*, published at cree.com/xlamp, September 2008.

Although the development of solid state light emitters (e.g., light emitting diodes) has in many ways revolutionized the lighting industry, some of the characteristics of solid state light emitters have presented challenges, some of which have not yet been fully met. For example, solid state light emitters are commonly seen in indicator lamps and the like, but are not yet in widespread use for general illumination.

Accordingly, for these and other reasons, efforts have been ongoing to develop ways by which solid state light emitters, which may or may not include luminescent material(s), can be used in place of incandescent lights, fluorescent lights and other light-generating devices in a wide variety of applications. In addition, where light emitting diodes (or other solid state light emitters) are already being used, efforts are ongoing to provide solid state light emitters that are improved, e.g., with respect to energy efficiency, color rendering index (CRI Ra), contrast, efficacy (lm/W), cost, duration of service, convenience and/or availability for use in different aesthetic orientations and arrangements.

In order to encourage development and deployment of highly energy efficient solid state lighting (SSL) products to replace several of the most common lighting products currently used in the United States, including 60-Watt A19 incandescent and PAR 38 halogen incandescent lamps, the Bright Tomorrow Lighting Competition (L Prize™) has been authorized in the Energy Independence and Security Act of 2007 (EISA). The L Prize is described in "*Bright Tomorrow Lighting Competition* (*L Prize*™)", May 28, 2008, Document No. 08NT006643. The L Prize winner must conform to many product requirements including light output, wattage, color rendering index, correlated color temperature, expected lifetime, dimensions and base type.

Presently, the predominant lighting fixture in specification homes is the dome light. Because the dome light is comparatively inexpensive, provides adequate light in a relatively even distribution, and in some cases does not require anything other than a simple junction box in a ceiling to install, it is in widespread use.

Currently, dome lights typically use two 60 Watt A-lamps shining light through a low optical efficiency dome to deliver between 600-900 lumens into the space. One approach to providing an energy-efficient replacement for such a fixture would be to simply replace the A-lamps with LED lamps. Such an approach could provide a drop from 120 Watts to 24 Watts (2×12 W) or less. Utilizing LED lamps in a traditional dome light would generally result in the premature failure of those lamps, because incandescent dome lights are not constructed in a manner that would allow the LED lamps to run cool.

Thus, there is a need to develop efficient LED fixtures that are lightweight, have a low height profile, and are easy to install in existing lighting spaces, such as ceiling or wall recesses, for example.

Cree, Inc. produces a variety of recessed downlights, such as the LR-6 and CR-6, which use LEDs for illumination. SSL panels are also commonly used as backlights for small liquid crystal display (LCD) screens, such as LCD display screens used in portable electronic devices, and for larger displays, such as LCD television displays.

SSL devices are typically powered with a DC signal. However, power is conventionally delivered in DC form. It is therefore generally desirable for a solid state light fixture to include an AC-DC converter to convert AC line voltage to a DC voltage.

Boost converters can be used to generate DC voltage from an ac line voltage with high power factor and low total harmonic distortion. The voltage of an LED-based load may be higher than the peak of the input (line) ac voltage. In that case, a single-stage boost converter can be employed as the driver, achieving high power efficiency and low cost. For example, a power factor corrected (PFC) boost converter which converts 120V ac, 60 Hz, to 200-250V dc output could be used to drive an array of high-voltage (HV) LEDs at a power level of 10-15 W.

For general lighting applications, it is desirable for an SSL apparatus to be compatible with a phase-cut dimming signal. Phase-cut dimmers are commonly used to reduce input power to conventional incandescent lighting fixtures, which causes the fixtures to dim. Phase-cut dimmers only pass a portion of the input voltage waveform in each cycle. Thus, during a portion of a phase-cut ac input signal, no voltage is provided to the fixture.

Compatibility with phase cut dimming signals is also feasible for LED drivers based on boost converters. One low cost approach is to use open-loop control, which means a driver will not respond to the LED current decrease due to phase cut dimming, but rather keep the preset input current during dimmer conduction time. In this way, a "natural" dimming performance is achieved, and input power, and thus LED current, will reduce as the dimmer conduction time decreases. Another approach uses closed-loop control for the driver. As control loops are complete and in effect, these drivers will try to compensate the input power decrease due to dimmer phase cut. In order to dim LEDs in these cases, the control loops should be saturated so that the input current cannot increase. The control loop saturation can be realized by clamping the output of an error amplifier, for example.

SUMMARY OF THE INVENTION

An embodiment of a lighting device comprises the following elements. A housing comprises a base and an open end opposite the base. The housing is shaped to define an internal optical chamber. At least one LED is in the optical chamber. A driver circuit is in the optical chamber.

An embodiment of a lighting device comprises the following elements. A housing comprises a base and an open end opposite the base. The housing is shaped to define an internal optical chamber. A driver circuit is in the optical chamber. A junction box is detachably connected to the base. The junction box comprises a mount structure for mounting the lighting device to an external surface.

BRIEF DESCRIPTION OF THE DRAWINGS

FIG. 1 is a perspective view of a lighting device according to an embodiment of the present invention.

FIG. 2 is a perspective view of a lighting device according to an embodiment of the present invention.

FIG. 7 is a cross-sectional view of a lighting device in one mount configuration according to an embodiment of the present invention.

FIG. 8 is a cross-sectional view of a lighting device in another mount configuration according to an embodiment of the present invention.

FIG. 9 is a perspective view of the bottom side of a lighting device according to an embodiment of the present invention.

FIG. 10 is a side perspective view of a lighting device according to an embodiment of the present invention.

FIG. 11 is an exploded view of a lighting device according to an embodiment of the present invention.

DETAILED DESCRIPTION OF THE INVENTION

Figure 3:
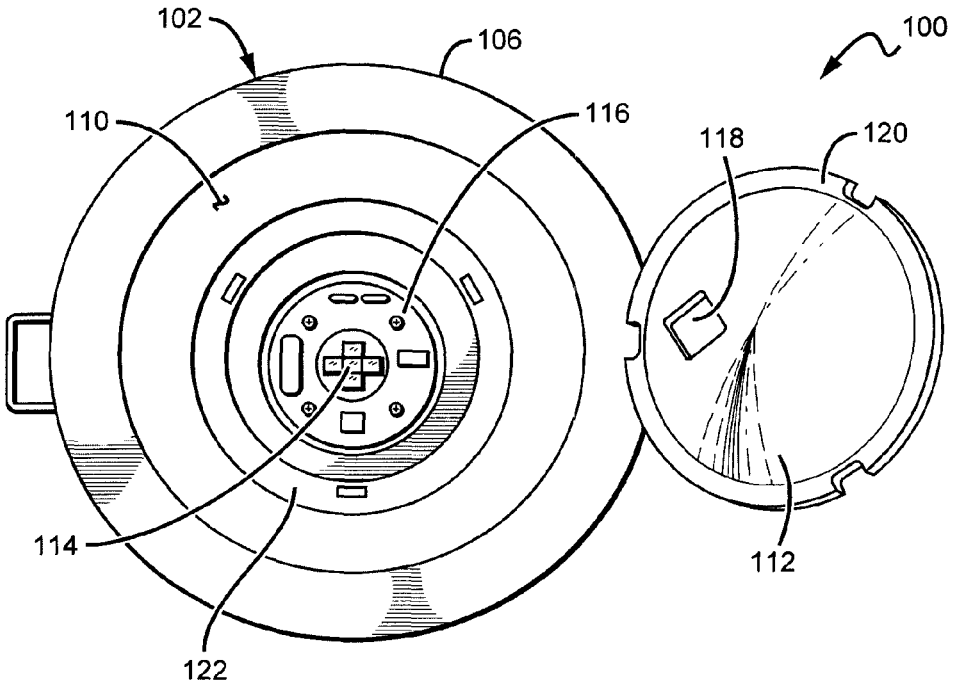
FIG. 3 is a perspective view of the lighting device according to an embodiment of the present invention with a portion removed to expose internal elements.

Embodiments of the invention provide a solid state lighting fixture with an integrated driver circuit. A housing designed to protect the light sources and the electronic components has a base end and an open end through which light is emitted from the fixture. The reflective interior surface of the fixture and the base define an optical chamber. At least one, and often multiple, light sources are mounted at the fixture base along with the circuitry necessary to drive and/or control the light sources. In order to minimize the overall size of the fixture, the drive circuit and the light sources are both located in the optical chamber. A reflective cone fits within the optical chamber such that it covers most of the drive circuit and other components at the base of fixture that might absorb light. The reflective cone is shaped to define a hole that is aligned with the light sources so that light may be emitted through the hole toward the open end of the fixture.

Embodiments of the present invention are described herein with reference to conversion materials, wavelength conversion materials, phosphors, phosphor layers and related terms. The use of these terms should not be construed as limiting. It is understood that the use of the term "phosphor" or "phosphor layers" is meant to encompass and be equally applicable to all wavelength conversion materials.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. For example, the term may be used to describe a single blue LED, or it may be used to describe a red LED and a green LED in proximity emitting as a single source. Thus, the term "source" should not be construed as a limitation indicating either a single-element or a multi-element configuration unless clearly stated otherwise.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength.

Embodiments of the invention are described herein with reference to cross-sectional view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the invention.

FIG. 1 is a perspective view of a lighting device 100 according to an embodiment of the present invention. A housing 102 comprises a base 104 and an open end 106 through which light is emitted during operation. A junction box 108 is detachably mounted to the housing 102. The junction box 108 has a mount mechanism (not shown) for mounting to an external surface, such as a ceiling or a wall, for example. The junction box 108 can be mounted to an external structure using screws, wires, straps, and many other known attachment mechanisms. The junction box 108 should be easily detachable and re-attachable to the base 104 to allow for easy access to the junction box 108 for maintenance. Because the junction box 108 can remain attached to the external structure, it is also easy to remove, repair, and/or replace the housing 102 or any of its internal components. In this embodiment, spring clips 109 are used to mount the device 100 to the ceiling drywall or the insulation tile, for example, eliminating the need for a "can" recess in the ceiling. Other mount structures may be suitable.

The lighting device 100 and other embodiments of the present invention provide a variety of advantages over traditional fixtures. During remodeling of a commercial or residential space, for example, it may not initially be known that there is not enough space or that there may be obstructions (e.g., piping, wiring, ductwork) that would prevent the use of a housing (can) in the ceiling. In many instances, this is discovered after cutting a hole in the ceiling. Some embodiments of the invention eliminate the need for the housing (can) altogether. This would be very important for consumers as material and installation costs associated with the fixture are reduced. For example, attaching a junction box 108 to the fixture provides enough space to terminate the electrical wiring. The junction box 108 may be detachable allowing for easy maintenance or replacement. In some embodiments, a junction box may be located on the side of the fixture to minimize the height of the fixture. The device 100 may be mounted with spring clips directly to the ceiling tile or drywall (as shown in FIG. 7). Since solid state light sources are efficient and the temperature range of the device 100 is within safe limits, insulation can be placed around it. Thus, embodiments of the present invention may pose less of a fire hazard than typical incandescent downlights. Additionally, these embodiments allow for quicker installation and subsequent safety inspection.

Figure 4:
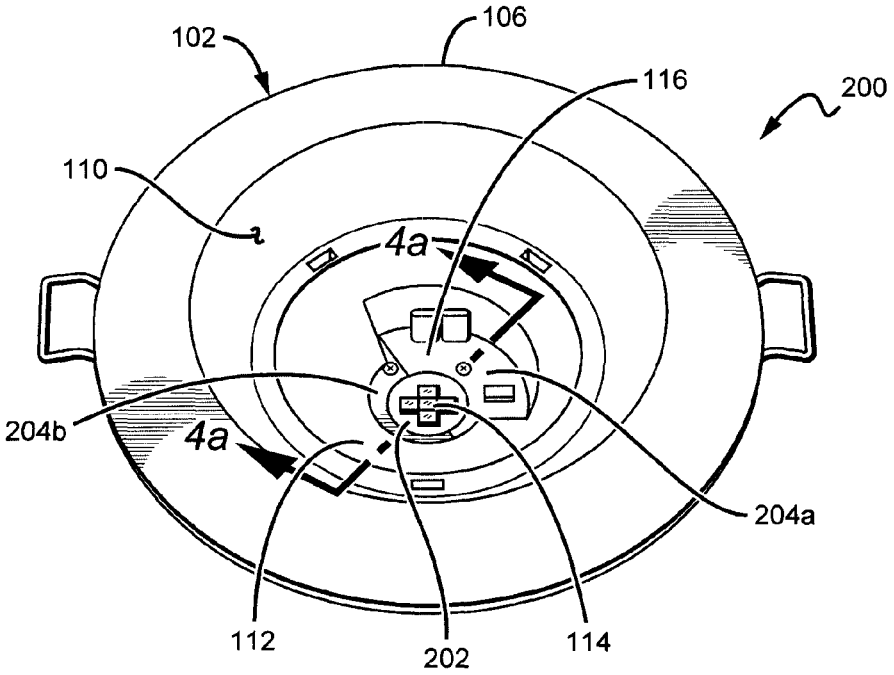
FIG. 4 is a perspective view of a lighting device according to an embodiment of the present invention.

FIG. 2 is a perspective view of the lighting device 100. The housing 102 and the interior surface of the base 104 are shaped to define an optical chamber 110. The interior surface of the housing 102 is reflective and shaped to redirect light out of the open end 106 to create a desired output profile. A reflector cone 112 fits inside the housing 102 and functions to cover the driver circuit 116 and any other absorptive elements at the base 104 of the housing, as best shown in FIGS. 3 and 4. The interior surface of reflector cone 112 is shaped to create a smooth surface transition at the intersection with the interior surface of the housing 102. The reflector cone 112 can be held in place inside the housing 102 using an adhesive, screws, or a snap-fit groove structure, for example.

FIG. 3 is a perspective view of the lighting device 100, looking into the open end 106 with the reflector cone 112 removed to expose the elements disposed in the base 104. This particular embodiment comprises five LEDs 114 disposed at the base 104 in the optical chamber 110. There can be more or fewer than five light sources in other embodiments. Here, the LEDs 114 and the driver circuit 116 are on a single circuit board with the LEDs 114 disposed in the middle portion of base 104 and surrounded by elements of the drive circuit 116 which powers and controls the output of the LEDs 114. Many driver circuits may be used, with some suitable circuits discussed in more detail herein. In other embodiments the LEDs and the driver circuit may be mounted on separate boards as discussed in more detail herein. As shown, both the LEDs 114 and the drive circuit 116 are housed within the optical chamber 110. This compact arrangement obviates the need for a separate recessed can" (i.e. 4" or 6" recessed housing commonly used for recessed downlights) to hold the device 100. Thus, lighting devices according to embodiments of the invention are lightweight, have reduced height, and are easier to install.

The reflector cone 112 is shown removed from the housing 102. The reflector cone 112 is shaped to define a hole 118. When the reflector cone 112 is mounted inside the housing 102, the hole 118 aligns with the LEDs 114, and in some embodiments, the LEDs 114 protrude through the hole 118 into the optical chamber 110. Thus, when mounted the reflector cone 112 prevents light emitted from the LEDs 114 from being absorbed by any elements of the drive circuit 116 by shielding off those absorptive elements from the rest of the optical chamber 110. In this particular embodiment, a flange 120 of reflector cone 118 is mounted with screws or pins to a ridge 120 on the interior of the housing 102. In some embodiments the reflective cone may be omitted for cost savings, and the drive circuit may be covered by a reflective paint. Other structures and/or materials may also be used to reflect light away from the drive circuit 116.

Figure 4A:
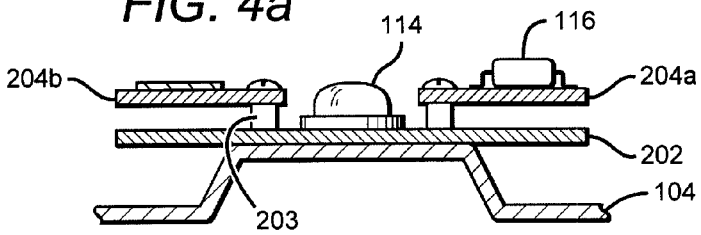
FIG. 4*a* is a cross-sectional view taken along the line A-A of the lighting device of FIG. 4.

FIG. 4 is a perspective view of another lighting device 200 according to an embodiment of the present invention. In FIG. 4, a portion of the reflector cone 112 has been removed to reveal the elements beneath. FIG. 4*a* is a cross-sectional view of the lighting device 200 shown in FIG. 4. The device 200 shares several elements in common with the device 100; thus, like elements are identified using the same reference numerals. This particular embodiment comprises LEDs 114 on a first circuit board 202 and the driver circuit 116 on a second circuit board 204. The first circuit board 202 is under the second circuit board 204 with a spacer 203 between the two boards 202, 204 to provide electrical isolation. In this embodiment, the second board 204 which contains the driver circuit 116 comprises two halves 204*a*, 204*b* with a cutout portion in the center. All of the driver circuit 116 elements are on one half of the second board 204*a*. The other half 204*b* comprises a piece of metal, such as copper, for thermal dissipation. The LEDs 114 are on the first board 202 and protrude up through the cutout portion of the second board 204 as shown in FIG. 4*a*. The LEDs then further protrude up through the hole in the reflector cone 112. In this embodiment, spring clips 109 are used to mount the device 200 to the ceiling drywall or the insulation tile, although other mount structures may be suitable.

Figure 5:
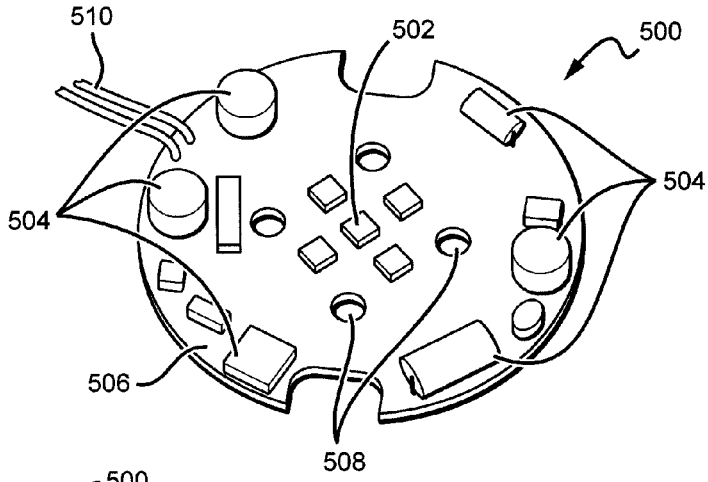
FIG. 5 is a top view of a circuit element for use in lighting devices according to embodiments of the present invention.

FIG. 5 is a top view of a circuit element 500 for use in lighting devices according to embodiments of the present invention. The element 500 provides a surface for a plurality of LEDs 502 and various driver circuit components 504 are disposed. In this embodiment, the LEDs and the driver circuit 504 are disposed on the same circular circuit board 506. The circuit board is shaped to fit in the base of a housing similar to the housing 102 shown in FIG. 1. The driver circuit components 504 are arranged around the perimeter of the circuit board 506 with the LEDs 502 in the middle portion. Four bore holes 508 are cut from the circuit board 506 to allow for mounting to a housing using screws, pins, or the like. Leads 510 connect the LEDs 502 and the driver circuit 504 to an external power source through a junction box in some embodiments.

Figure 6:
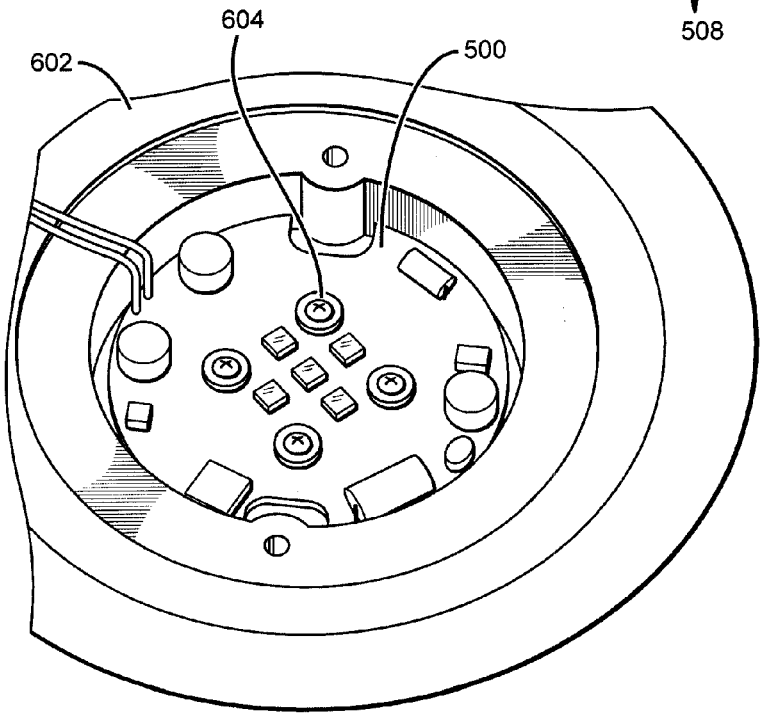
FIG. 6 is a perspective view of a circuit element mounted to the base of a housing.

The circuit element can be mounted to a housing using various mechanisms. FIG. 6 is a perspective view of the circuit element 500 mounted to the base of a housing 602 with washer/screws 604. Here, the reflector cone has been removed completely. Indeed, the reflector cone is excluded from some embodiments altogether.

FIG. 7 is a cross-sectional view of the lighting device 100 in one mount configuration according to an embodiment of the present invention. In this configuration the base 104 protrudes through the ceiling 702 into the plenum. The open end 106 is exposed beneath the ceiling 702 so the light is emitted into the room. The spring clips 109 urge the open end 106 of the housing 102 up against the ceiling, holding the lighting device 100 firmly against the ceiling 702. The portion of the lighting device 100 in the plenum above the ceiling 702 is surrounded by insulation 704.

FIG. 8 is a cross-sectional view of the lighting device 100 in another mount configuration according to an embodiment of the present invention. In this configuration, the junction box 108 is mounted directly to the ceiling with screws or the like. The housing 102 is removably attached to the junction box 108. In some cases, the junction box 108 may already be present at the ceiling during installation in which case the housing 102 is attached thereto. However, the junction box 108 and the housing 102 may be installed as a single unit.

FIG. 9 is a perspective view of the bottom side of a lighting device 900 according to an embodiment of the present invention. The device 900 comprises a housing having a base 904 (shown in FIG. 10) and an open end 906. Embodiments such as the device 900 may be described as a disc light. Disc lights are discussed generally in U.S. application Ser. No. 13/365,844 titled "LIGHTING DEVICE AND METHOD OF INSTALLING LIGHT EMITTER", which is commonly assigned with the present application and incorporated by reference herein. The housing 902 is shaped to define an optical chamber which is obscured in this view by a lens plate 908. An electrical connector 910 is used to connect the device 900 to an external power source, for example, in a junction box. In some embodiments, the connector 910 can connect to an adapter that interfaces with a standard Edison screw socket such that the device 900 can be easily integrated into existing electrical architecture where traditional incandescent bulbs had been previously used.

The lens plate 908 is used to further mix the outgoing light and reduce imaging of the sources in the optical chamber (i.e., hotspots). In this embodiment, the plate 908 is attached to the housing 902 with a snap-fit connection. In other embodiments, the plate 908 may be attached to the housing with an adhesive, screws, or the like. Here, the lens plate 908 comprises a diffusive element. The lens plate 908 functions in several ways. For example, it can prevent direct visibility of the sources 918 and provide additional mixing of the outgoing light to achieve a visually pleasing uniform source. However, a diffusive lens plate can introduce additional optical loss into the system. Thus, in embodiments where the light is sufficiently mixed by a reflector cone or by other elements within the optical chamber, a diffusive lens plate may be unnecessary. In such embodiments, a transparent glass lens plate may be used, or the lens plates may be removed entirely. In still other embodiments, scattering particles may be included in the lens plate.

Diffusive elements in the lens plate 908 can be achieved with several different structures. A diffusive film inlay can be applied to the top- or bottom-side surface of the lens plate 908. It is also possible to manufacture the lens plate 908 to include an integral diffusive layer, such as by coextruding the two materials or insert molding the diffuser onto the exterior or interior surface. A clear lens may include a diffractive or repeated geometric pattern rolled into an extrusion or molded into the surface at the time of manufacture. In another embodiment, the lens plate material itself may comprise a volumetric diffuser, such as an added colorant or particles having a different index of refraction, for example.

In other embodiments, the lens plate 908 may be used to optically shape the outgoing beam with the use of microlens structures, for example. Many different kinds of beam shaping optical features can be included integrally with the lens plate 908.

FIG. 10 is a side perspective view of the lighting device 900. The base 912 of the housing 902 surrounds the electronics and the light sources that are disposed in the optical chamber. The device 900 may be connected directly to a surface such as a ceiling, a wall, or a junction box, or it mounted such that the base 912 extends through the ceiling and into the plenum in which case it may be mounted using clips similarly as device 100 shown in FIG. 7.

The device 900 has a compact profile such that it can easily fit within existing fixture spaces. Embodiments of the invention provide for a downlight fixture in which the light sources (e.g., LEDs) and the driver circuitry can be housed in the optical chamber which is recessed from the ceiling plane. A recessed fixture is desirable from an architectural perspective as the glare is reduced for the occupants in a living or work space. In some LED fixtures, the driver circuitry is mounted outside the optical chamber which increases the overall height of the fixture. In many buildings there is not enough space above the ceiling to accommodate such a fixture. Embodiments of the present invention provide a fixture with reduced height such that it can be used even when plenum space is limited.

FIG. 11 is an exploded view of the lighting device 900. The lens plate 908 and a reflector cone 914 have been removed to reveal electronic components including a driver circuit 916 and a plurality of LED light sources 918 mounted to the inside surface of the housing base 912. In this particular embodiment, five LED light sources 918 are mounted on the base 912 in the optical chamber, although it is understood that various different configurations with any number of light sources may be used. The reflector cone 914 is shaped to define a hole that aligns with the light sources 918 when the reflector cone 914 is attached to the housing 902.

The reflector cone 914 comprises a reflective inner surface that functions to redirect light emitted from the sources 918 away from absorptive elements at the housing base 912, such as the driver circuit 916. Thus, the reflector cone 914 surface may comprise a diffuse white reflector such as a microcellular polyethylene terephthalate (MCPET) material or a Dupont/WhiteOptics material, for example. Other white diffuse reflective materials can also be used.

Diffuse reflective coatings mix the light from solid state light sources having different spectra (i.e., different colors). These coatings are particularly well-suited for multi-source designs where two different spectra are mixed to produce a desired output color point. For example, LEDs emitting blue light may be used in combination with LEDs emitting yellow (or blue-shifted yellow) light to yield a white light output. A diffuse reflective coating may eliminate the need for additional spatial color-mixing schemes that can introduce lossy elements into the system; although, in some embodiments it may be desirable to use a diffuse reflector cone in combination with other diffusive elements. For example, in this particular embodiment, the reflector cone 914 is paired with the diffuser plate 908 to effectively mix the outgoing light.

By using a diffuse white reflective material for the reflector cone 914 several design goals are achieved. For example, the reflector cone 914 performs a color-mixing function. A diffuse white material also provides a uniform luminous appearance in the output.

The reflector cone 914 can comprise materials other than diffuse reflectors. In other embodiments, the reflector cone 914 can comprise a specular reflective material or a material that is partially diffuse reflective and partially specular reflective. In some embodiments, it may be desirable to use a specular material in one area and a diffuse material in another area. For example, a semi-specular material may be used on the center region with a diffuse material used in the side regions to give a more directional reflection to the sides. Many combinations are possible. It may also be desirable to texture the inner surface of the reflector cone 914 to achieve a desired optical effect.

Figure 12:
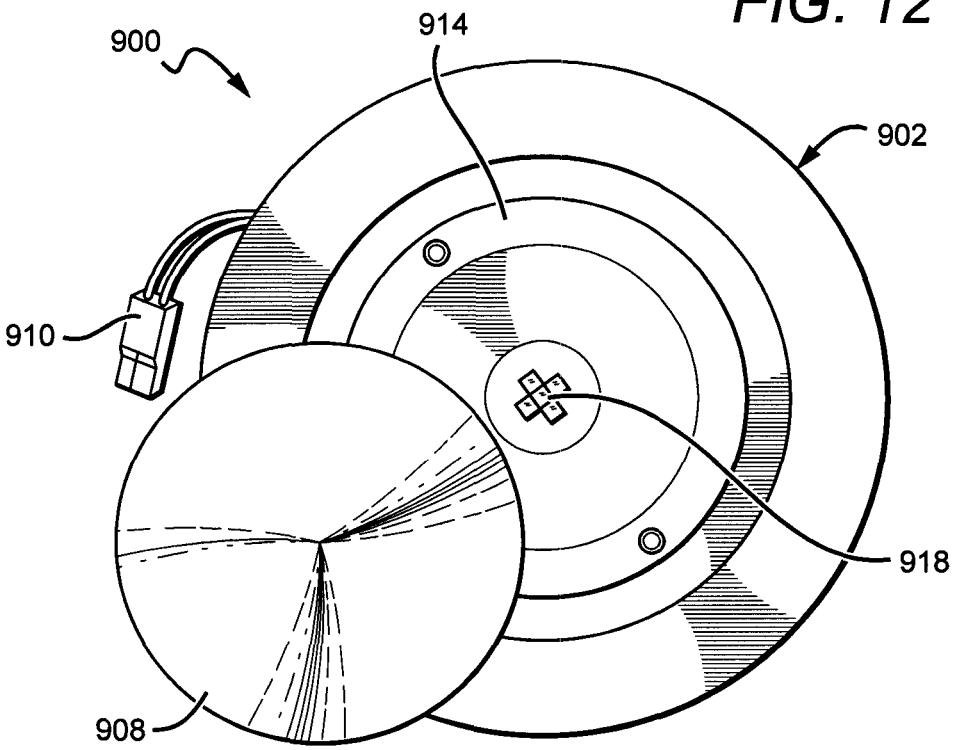
FIG. 12 is a bottom perspective view of a lighting device according to an embodiment of the present invention.

FIG. 12 is a bottom perspective view of the lighting device 900. In this view the lens plate 908 is removed to reveal the optical chamber. Here, the reflector cone 914 is mounted to the base 912 within the optical chamber. The light sources 918 are arranged at the base of the chamber. The reflector cone 914 hole is aligned with the sources 918 such that they protrude through the reflector cone 914 hole into the optical chamber, and the driver circuit 916 is obscured from view by the reflector cone 914.

Figure 13:
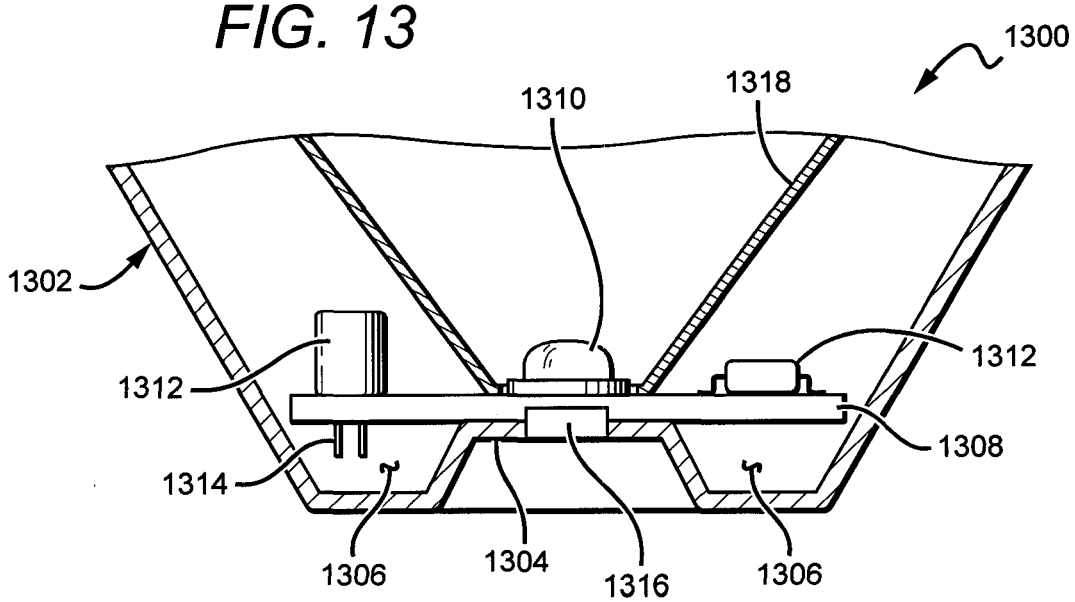
FIG. 13 is a cross-sectional view of the base portion of a lighting device according to an embodiment of the present invention.

FIG. 13 is a cross-sectional view of the base portion of a lighting device 1300 according to an embodiment of the present invention. In this embodiment, the housing 1302 comprises a raised mount surface 1304 in the center of the housing base. The raised surface 1304 defines a circular cavity 1306 running around the perimeter of the housing base. A single circuit board 1308 provides the mount surface for the LEDs 1310 and the driver circuit components 1312. Similarly as in the circuit element 500, the driver circuit components 1312 are arranged around the perimeter of the board 1308. The circular cavity 1306 beneath provides space below the driver circuit components 1312, allowing for the use of through-hole components 1314 and, thus, a double-sided circuit board. The cavity 1306 provides electrical isolation for any through-hole and/or backside components from the housing 1302. In some embodiments a metal core circuit board may be used to facilitate thermal dissipation from the LEDs 1310 to the housing 1302. Here, a metal slug 1316, for example copper, is disposed between the LEDs 1310 and the housing to provide a bulk low-thermal resistance pathway from the heat-generating LEDs 1310 to the housing 1302. The reflector cone 1318 is arranged to shield light emitted from the LEDs 1310 from the absorptive elements such as the circuit board 1308 and the driver circuit components 1312.

Figure 14:
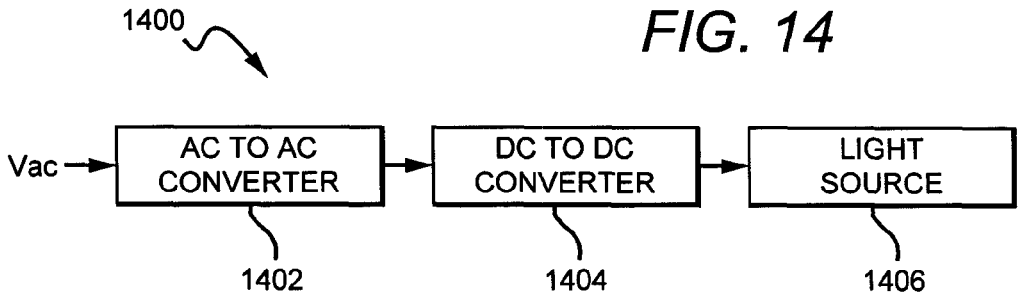
FIG. 14 is a block diagram of a circuit that may be used in embodiments of the present invention.

Various driver circuits may be used to power the light sources. Suitable circuits are compact enough to fit within the base of a particular housing while still providing the power delivery and control capabilities necessary to drive high-voltage LEDs, for example. FIG. 14 is a block diagram of a circuit 1400 that may be used in embodiments of the present invention. An AC line voltage $V_{ac}$ comes in where it is converted to DC at the AC to DC converter 1402. The resulting DC voltage is then either adjusted up or down with a DC to DC converter 1404 to meet the requirements of the light source 1406.

At the most basic level a driver circuit may comprise an AC to DC converter, a DC to DC converter, or both. In one embodiment, the driver circuit comprises an AC to DC converter and a DC to DC converter both of which are located inside the optical chamber. In another embodiment, the AC to DC conversion is done remotely (i.e., outside the optical chamber), and the DC to DC conversion is done at the control circuit inside the optical chamber. In yet another embodiment, only AC to DC conversion is done at the control circuit within the optical chamber.

Figure 15:
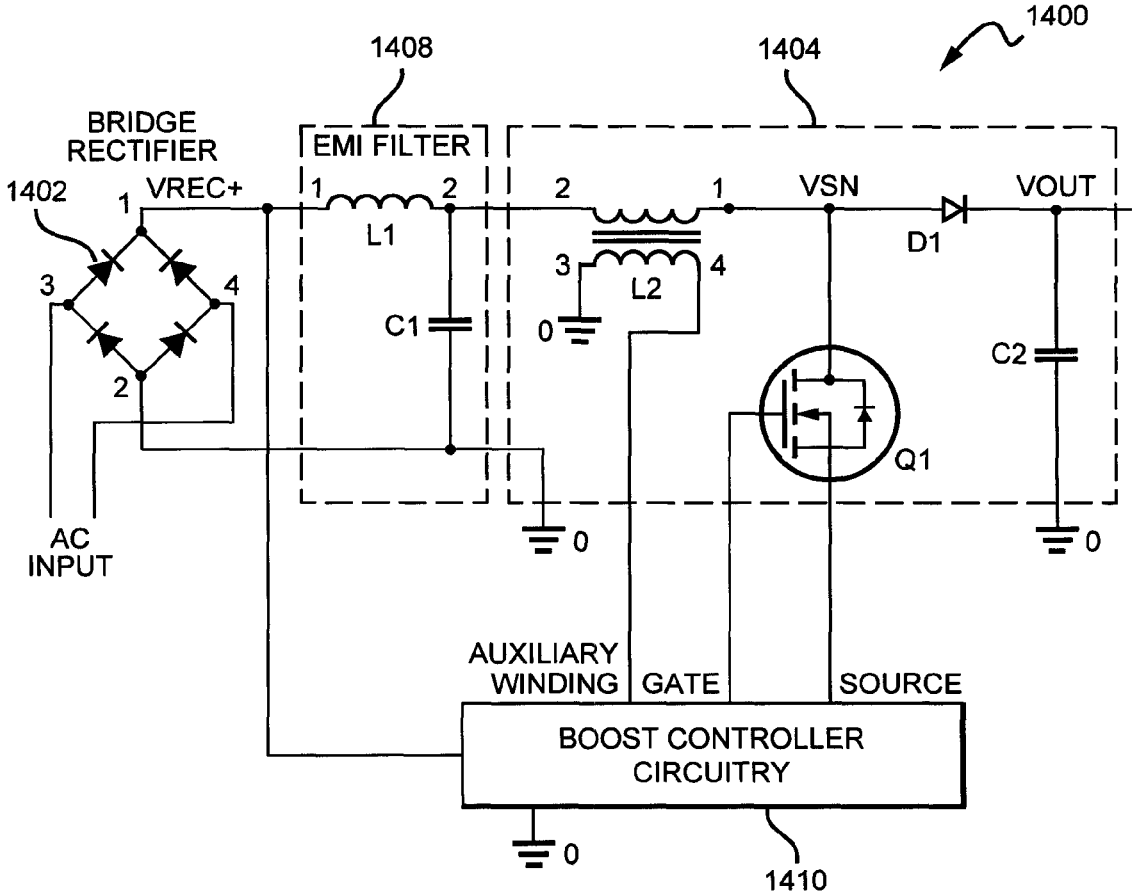
FIG. 15 is a diagram of a driver circuit that may be used in embodiments of the present invention.

Referring to both FIGS. 14 and 15, this particular embodiment of the driver circuit 1400 includes a rectifier as the AC to DC converter 1402 that is configured to receive an AC line voltage. The AC to DC converter 1402 may be a full-wave bridge rectifier as shown in FIG. 15 and is referred to as such in this embodiment. The output of the rectifier 1402, which may be a full-wave rectified AC voltage signal, is provided to the DC to DC converter 1404 which can be a switched-mode power supply, for example, and is referred to as such in this embodiment. In response to the rectified AC signal, the switched-mode power supply 1404 generates a DC voltage that is supplied to the light source 1406.

As shown in FIG. 15, an EMI filter 1408 including a series inductor L1 and a shunt capacitor C1 may be provided at an input to the switched-mode power supply 1404. The EMI filter 1408 is a low pass filter that filters electromagnetic interference from the rectified line voltage.

In some embodiments, the switched-mode power supply 1404 is a boost circuit including a boost inductor L2, a switch Q1, a boost diode D1 and a boost or output capacitor C2. The switch Q1 may be a MOSFET switch. The boost inductor L2 may include a transformer having a primary winding and an auxiliary winding. The primary winding of the boost inductor is coupled at one end to the input of the switched-mode power supply 1404 and at the other end to the anode of the boost diode D1 and the drain of the switch Q1.

Operation of the switched-mode power supply 1404 is controlled by boost controller circuitry 1410, which is coupled to the output of the rectifier 1402, the gate and source of the switch Q1, and the output of the switched-mode power supply 1404. In addition, the boost controller circuitry 1410 is coupled to the auxiliary winding of the boost inductor L2. However, the boost controller circuitry 1410 may not draw bias or housekeeping power from the auxiliary winding of the boost inductor L2.

In one embodiment the boost controller, which may be implemented, for example, using a TPS92210 Single-Stage PFC Driver Controller for LED Lighting manufactured by Texas Instruments can be configured in a constant on time-boundary conduction mode. In this mode the switch Q1 is turned on for a fixed time ($T_{on}$) allowing for a ramp up of the current in the inductor L2. The switch Q1 is turned off and the inductor current ramps down to zero while supplying current to the output capacitor C2 through D1. The controller detects when the current falls to zero and initiates another turn-on of Q1. The peak input current in a switching period is given by given by $V_{in}*T_{on}/L$ which is proportional to $V_{in}$. Although the switching frequency varies over the line period, the average input current remains near sinusoidal and achieves a close to unity power factor.

In another embodiment, a boost controller, such as an L6562 PFC controller manufactured by STMicroelectronics, can be used in constant off-time continuous conduction mode. In this mode, the current reference for the switch current is obtained from the input waveform. The switch is operated with a fixed off time. In another embodiment, the average inductor current is sensed with a resistor and is controlled to follow the sinusoidal input voltage with a controller IC such as an IRF1155S manufactured by International Rectifier. Any of these controllers can be operated in constant power mode by operating them in open loop and fixing the controller reference, such as on-time or error-amplifier output, to a value that determines the power. The power transferred to the output is dumped into the load LEDs, which clamp the output voltage and in doing so define the output current.

Although a connection is shown from the auxiliary winding of L2 to the boost controller 1410, a power factor compensating (PFC) boost converter for an LED driver circuit according to some embodiments may not draw bias or housekeeping power from the auxiliary winding of the boost converter. Rather, the boost controller may draw the auxiliary power from bottom of the LED string or from the drain node of the switch. Moreover, a PFC boost converter for an LED driver according to some embodiments may not use feedback from the LED voltage (VOUT) to control the converter.

The boost circuit 1404 steps up the input voltage using basic components, which keeps the cost of the circuit low. Moreover, additional control circuitry can be minimal and the EMI filter 1408 can be small.

The boost circuit 1404 achieves high efficiency by boosting the output voltage to a high level (for example about 170V or more). The load currents and circuit RMS currents can thereby be kept small, which reduces the resulting $I^2R$ losses. An efficiency of 93% can be achieved compared to 78-88% efficiency of a typical flyback or buck topology.

The boost converter 1404 typically operates from 120V AC, 60 Hz (169 V peak) input and converts it to around 200V DC output. Different output voltages within a reasonable range (170V to 450V) can be achieved based on various circuit parameters and control methods while maintaining a reasonable performance. If a 230V AC input is used (such as conventional in Europe), the output may be 350V DC or higher.

In one embodiment the boost converter is driven in constant power mode in which the output LED current is determined by the LED voltage. In constant power mode, the boost controller circuitry may attempt to adjust the controller reference in response to changes in the input voltage so that the operating power remains constant.

When operated in constant power mode, a power factor correcting boost voltage supply appears nearly as an incandescent/resistive load to the AC supply line or a phase cut dimmer. In case of a resistive load, the input current has the same shape as the input voltage, resulting in a power factor of 1. In constant power mode the power supply circuit 1404 and light source 1406 offer an equivalent resistance of approximately 1440Ω at the input, which means 10 W of power is drawn from the input at 120V AC. If the input voltage is dropped to 108V AC, the power will drop to approximately 8.1 W. As the AC voltage signal on the input line is chopped (e.g. by a phase cut dimmer), the power throughput gets reduced in proportion and the resulting light output by the light source 1406 is dimmed naturally. Natural dimming refers to a method which does not require additional dimming circuitry. Other dimming methods need to sense the chopped rectified AC waveform and convert the phase-cut information to LED current reference or to a PWM duty cycle to the dim the LEDs. This additional circuitry adds cost to the system.

A boost converter according to some embodiments does not regulate the LED current or LED voltage in a feedback loop. That is, the boost converter may not use feedback from the LED voltage (VOUT) to control the converter. However both of these inputs could be used for protection such as over-voltage protection or over-current protection. Since the boost converter operates in open loop, it appears as a resistive input. When a PWM converter controls its output voltage or output current and when the input voltage is chopped with a dimmer, it will still try to control the output to a constant value and in the process increase the input current.

More details of circuits similar to the circuit 1400 are given in U.S. application Ser. No. 13/662,618 titled "DRIVING CIRCUITS FOR SOLID-STATE LIGHTING APPARATUS WITH HIGH VOLTAGE LED COMPONENTS AND RELATED METHODS," which is commonly owned with the present application by CREE, INC., which was filed on 29 Oct. 2012, and which is incorporated by reference as if fully set forth herein.

Additional details regarding driver circuits are given in U.S. application Ser. No. 13/462,388 titled "DRIVER CIRCUITS FOR DIMMABLE SOLID STATE LIGHTING APPARATUS," which is commonly owned with the present application by CREE, INC., which was filed on 2 May 2012, and which is incorporated by reference as if fully set forth herein.

Additional details regarding driver circuits are given in U.S. application Ser. No. 13/207,204 titled "BIAS VOLTAGE GENERATION USING A LOAD IN SERIES WITH A SWITCH," which is commonly owned with the present application by CREE, INC., which was filed on 10 Aug. 2011, and which is incorporated by reference as if fully set forth herein.

It is understood that embodiments presented herein are meant to be exemplary. Embodiments of the present invention can comprise any combination of compatible features shown in the various figures, and these embodiments should not be limited to those combinations expressly illustrated and discussed. For example, many different driver circuits and LED components may be used without departing from the scope of the invention. Although the present invention has been described in detail with reference to certain configurations thereof, other versions are possible. Therefore, the spirit and scope of the invention should not be limited to the versions described above.

I claim:

1. A lighting device, comprising:
a housing comprising:
a base;
an open end opposite said base;
an exterior surface; and
an interior surface of said housing opposite said exterior surface and shaped to define an internal optical chamber, at least a portion of said interior surface being reflective and shaped to redirect light out of said open end;
at least one LED in said internal optical chamber; and
a reflector cone in said internal optical cavity chamber, said reflector cone shaped to define a hole that aligns with said at least one LED;
wherein at least some light from said at least one LED is reflected by an interior surface of said reflector cone and said interior surface of said housing.

2. The lighting device of claim 1, further comprising a driver circuit in said internal optical chamber.

3. The lighting device of claim 1, wherein said LEDs protrude through said reflector cone hole into said internal optical chamber.

4. The lighting device of claim 1, further comprising a junction box detachably mounted to said housing base.

5. The lighting device of claim 4, said junction box comprising a mount mechanism for mounting to an external surface.

6. The lighting device of claim 2, said driver circuit comprising an AC to DC converter and a DC to DC converter.

7. The lighting device of claim 2, said driver circuit comprising a boost converter.

8. The lighting device of claim 2, said driver circuit comprising a step-down converter.

9. The lighting device of claim 2, said driver circuit comprising a buck-boost converter.

10. The lighting device of claim 2, wherein said at least one LED and said driver circuit are on a circuit board which is mounted to said base.

11. The lighting device of claim 2, wherein said at least one LED is on a first board and said driver circuit is on a second board.

12. The lighting device of claim 11, wherein said second board is stacked on said first board with a spacer there between, and wherein said at least one LED protrudes through said second board and into said internal optical cavity chamber.

13. The lighting device of claim 2, wherein said at least one LED is in the middle region of a circular circuit board and said driver circuit is arranged around the outer region of said circuit board.

14. The lighting device of claim 1, wherein said housing comprises a raised mount surface in the center of said base defining a circular cavity around said raised mount surface.

15. The lighting device of claim 2, wherein said at least one LED and said driver circuit are at said base of said housing.

16. A lighting device, comprising:
a housing comprising:
a base;
an open end opposite said base; and
an interior surface of said housing shaped to define an internal optical chamber, at least a portion of said interior surface being reflective and shaped to redirect light out of said open end;
at least one light source in said optical chamber; and
a reflector in said internal optical chamber, said reflector shaped to create a smooth surface transition at the intersection with the interior surface of the housing, said reflector shaped to define a hole that aligns with said at least one light source;
wherein at least some light from said at least one light source is reflected by an interior surface of said reflector and said interior surface of said housing.

17. The lighting device of claim 16, said at least one light source comprising at least one LED in said internal optical chamber.

18. The lighting device of claim 16, further comprising:
a driver circuit in said internal optical chamber; and
a junction box detachably connected to said base, said junction box comprising a mount structure for mounting said lighting device to an external surface.

19. The lighting device of claim 16, wherein said at least one light source protrudes through said reflector hole into said internal optical chamber.

20. The lighting device of claim 18, wherein said at least one light source and said driver circuit are on a circuit board which is mounted to said base.

21. The lighting device of claim 18, wherein said at least one light source is on a first board and said driver circuit is on a second board.

22. The lighting device of claim 21, wherein said second board is stacked on said first board with a spacer there between, and wherein said at least one light source protrudes through said second board and into said internal optical cavity chamber.

23. The lighting device of claim 18, wherein said at least one light source is in the middle region of a circular circuit board and said driver circuit is arranged around the outer region of said circuit board.

24. The lighting device of claim 18, said driver circuit comprising an AC to DC converter and a DC to DC converter.

25. The lighting device of claim 18, said driver circuit comprising a boost converter.

26. The lighting device of claim 18, said driver circuit comprising a step-down converter.

27. The lighting device of claim 18, said driver circuit comprising a buck-boost converter.

* * * * *